US011287779B2

(12) United States Patent
Spencer et al.

(10) Patent No.: US 11,287,779 B2
(45) Date of Patent: Mar. 29, 2022

(54) MODULAR SYSTEM FOR WATCH

(71) Applicant: Apple Inc., Cupertino, CA (US)

(72) Inventors: Maegan K. Spencer, La Honda, CA (US); Sherry Tang, Santa Clara, CA (US); Morgan T. McClure, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 462 days.

(21) Appl. No.: 16/385,973

(22) Filed: Apr. 16, 2019

(65) Prior Publication Data

US 2020/0050154 A1 Feb. 13, 2020

Related U.S. Application Data

(60) Provisional application No. 62/716,874, filed on Aug. 9, 2018.

(51) Int. Cl.
*G04G 17/04* (2006.01)
*G04G 21/04* (2013.01)
(Continued)

(52) U.S. Cl.
CPC ..... *G04G 17/045* (2013.01); *G04G 21/04* (2013.01); *G04G 21/08* (2013.01); *G04R 60/06* (2013.01)

(58) Field of Classification Search
CPC ..... G04G 17/045; G04G 21/04; G04G 21/08; G04G 21/02; G04G 21/00; G04G 17/083;
(Continued)

(56) References Cited

U.S. PATENT DOCUMENTS 4,419,770 A * 12/1983 Yagi ..... G04B 47/025 368/10
6,619,835 B2 9/2003 Kita
(Continued)

FOREIGN PATENT DOCUMENTS

CN 103546181 1/2014
CN 104243637 12/2014
(Continued)

OTHER PUBLICATIONS

Chinese Office Action from Chinese Patent Application No. 201910447547.9, dated Dec. 23. 2020, 22 pages including machine-generated English language translation.
(Continued)

*Primary Examiner* — Edwin A. Leon
(74) *Attorney, Agent, or Firm* — Morgan, Lewis & Bockius LLP

(57) ABSTRACT

Wearable electronic devices, such as watches, can be part of a modular system that provides a variety of different components and functions to achieve the results that are desired by a user. The modular configurations allow a user to easily customize a watch with one or more functional modules to provide features that integrate with other operations of the body of the watch. The functional modules can be easily exchanged with each other to provide different components and functions at different times. Accordingly, a watch body need not include permanent components that provide every function that will later be desired by the user. Instead, the watch can have expanded and customizable capabilities by the use of one or more functional modules.

18 Claims, 8 Drawing Sheets

(51) Int. Cl.
*G04G 21/08* (2010.01)
*G04R 60/06* (2013.01)

(58) Field of Classification Search
CPC ..... G04R 60/06; H01R 13/6278; H01R 13/6273; H01R 13/6275; H01R 13/6582; A44C 5/0015
USPC ..... 368/9
See application file for complete search history.

(56) References Cited

U.S. PATENT DOCUMENTS

| | | | | |
|---|---|---|---|---|
| 2001/0043514 | A1* | 11/2001 | Kita | G06F 1/163 368/281 |
| 2007/0064542 | A1* | 3/2007 | Fukushima | G04G 17/06 368/282 |
| 2014/0362544 | A1* | 12/2014 | Han | G04G 17/06 361/749 |
| 2016/0322745 | A1 | 11/2016 | Shedletsky | |

FOREIGN PATENT DOCUMENTS

| | | |
|---|---|---|
| CN | 204652475 | 9/2015 |
| CN | 204682716 | 10/2015 |
| CN | 105814752 | 7/2016 |
| CN | 205488895 | 8/2016 |
| CN | 205597332 | 9/2016 |
| CN | 106896713 | 6/2017 |
| CN | 207020474 | 2/2018 |
| EP | 2813907 | 12/2014 |
| EP | 2813907 | 12/2017 |
| JP | 2015010924 | 1/2015 |
| WO | WO 2015/099809 | 7/2015 |

OTHER PUBLICATIONS

Extended European Search Report from European Patent Application No. 19190893.8, dated Mar. 10, 2020, 11 pages.
Partial European Search Report from European Patent Application No. 19190893.8, dated Dec. 6, 2019, 15 pages.
Indian Office Action from Indian Patent Application No. 201914021579, dated Mar. 4, 2021, 8 pages.
Chinese Office Action from Chinese Patent Application No. 201910447547.9, dated Jul. 22, 2021, 27 pages including machine-generated English language translation.
Chinese Office Action from Chinese Patent Application No. 201910447547.9, dated Nov. 17, 2021, 17 pages including English language summary.
European Office Action from European Patent Application No. 19190893.8, dated Oct. 26, 2021, 5 pages.

* cited by examiner

MODULAR SYSTEM FOR WATCH

CROSS-REFERENCE TO RELATED APPLICATIONS

This application claims the benefit of U.S. Provisional Application No. 62/716,874, entitled "MODULAR SYSTEM FOR WATCH," filed Aug. 9, 2018, the entirety of which is incorporated herein by reference.

TECHNICAL FIELD

The present description relates generally to wearable devices, and, more particularly, to modular configurations for watches.

BACKGROUND

Electronic devices that can be worn on a user's wrist and do more than act as a simple time piece are growing in popularity. A variety of wearable electronic devices, including watches, have been developed that include components to provide a variety of functions. For example, some wearable electronic devices include one or more sensors to measure various characteristics of the user and/or the environment in which the device operates. Such devices may include a display to indicate the time and date. The devices may also include accelerometers and one or more sensors that enable a user to track fitness activities and health-related characteristics, such as heart rate, blood pressure, and body temperature, among other information. The devices also typically include a rechargeable battery that powers the electronics within the device.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
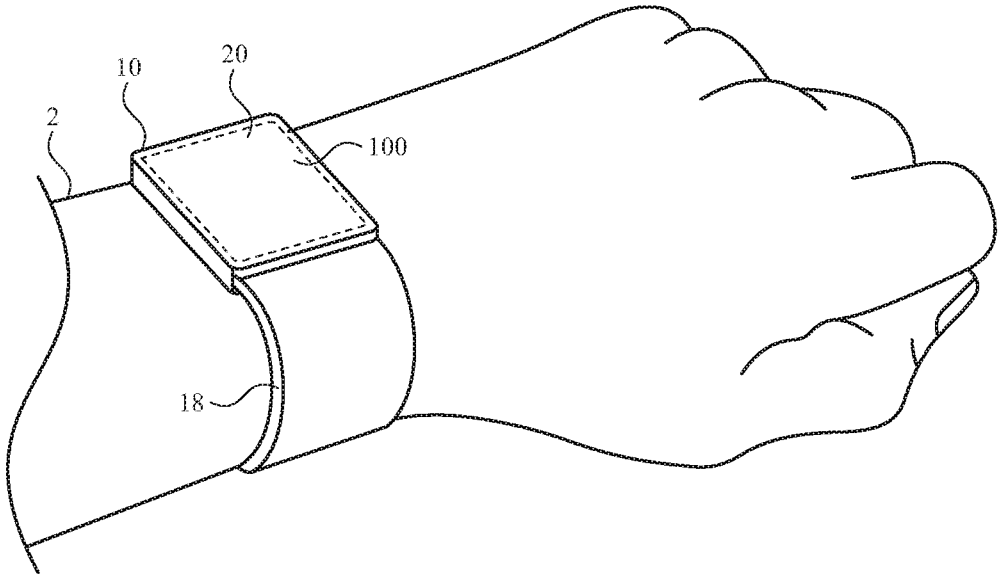
FIG. 1 illustrates a perspective view of a watch on a wrist of a user, according to some embodiments of the present disclosure.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

Wearable electronic devices, including watches, can perform a range of functions that is determined by the components (e.g., sensors, circuitry, and other hardware) included with the wearable device as manufactured. However, space, cost, and other considerations may limit the ability to provide every component that might provide a desired function. For example, different users may have different preferences regarding the components and functions that are provided by a given watch. Some users may desire certain health tracking capabilities, while other users may desire long battery life. Furthermore, a given user may desire different components and functions at different times. For example, a given user may desire health monitoring components and functions during exercise and components having certain cosmetic features during social activities.

Given the diversity of desired components and functions, it would be beneficial to allow a user to modify components and functions of a watch to customize the user experience according to the user's desires. Additionally or alternatively, it would be beneficial to allow a manufacturer to modify components and functions of a watch according to custom orders from a purchaser and/or to streamline a manufacturing process. Wearable electronic devices, including watches, of the present disclosure facilitate customization, adaptability, and modification by a user according to the user's desires.

Systems of the present disclosure can provide a watch with exchangeable modules that provide a variety of different components and functions to achieve the results that are desired by a user. The modular configurations allow a user to easily customize a watch with one or more functional modules to provide features that integrate with other operations of the body of the watch. The functional modules can be easily exchanged with each other to provide different components and functions at different times. Accordingly, a watch body of the present disclosure need not include permanent components that provide every function that will later be desired by the user. Instead, the watch can have expanded and customizable capabilities by the use of one or more functional modules.

These and other embodiments are discussed below with reference to FIGS. 1-14. However, those skilled in the art will readily appreciate that the detailed description given herein with respect to these Figures is for explanatory purposes only and should not be construed as limiting.

According to some embodiments, for example as shown in FIG. 1, a watch 10 includes a watch body 100 that is worn on a wrist 2 with a watch band 18. The body 100 can be portable and also attached to other body parts of the user or to other devices, structures, or objects. The watch band 18 can be flexible and encircle at least a portion of the wrist 2 of a user. By securing the watch body 100 to the person of the user, the watch band 18 provides security and convenience. In some embodiments, the watch body 100 includes a display 20 and a housing for containing components.

It will be appreciated that the teachings relating to a watch can be applied to other electronic devices, including wearable and/or portable computing devices. Examples include timekeeping devices, computerized glasses, navigation devices, sports devices, accessory devices, health-monitoring devices, medical devices, wristbands, bracelets, jewelry, and/or the like.

Figure 2:
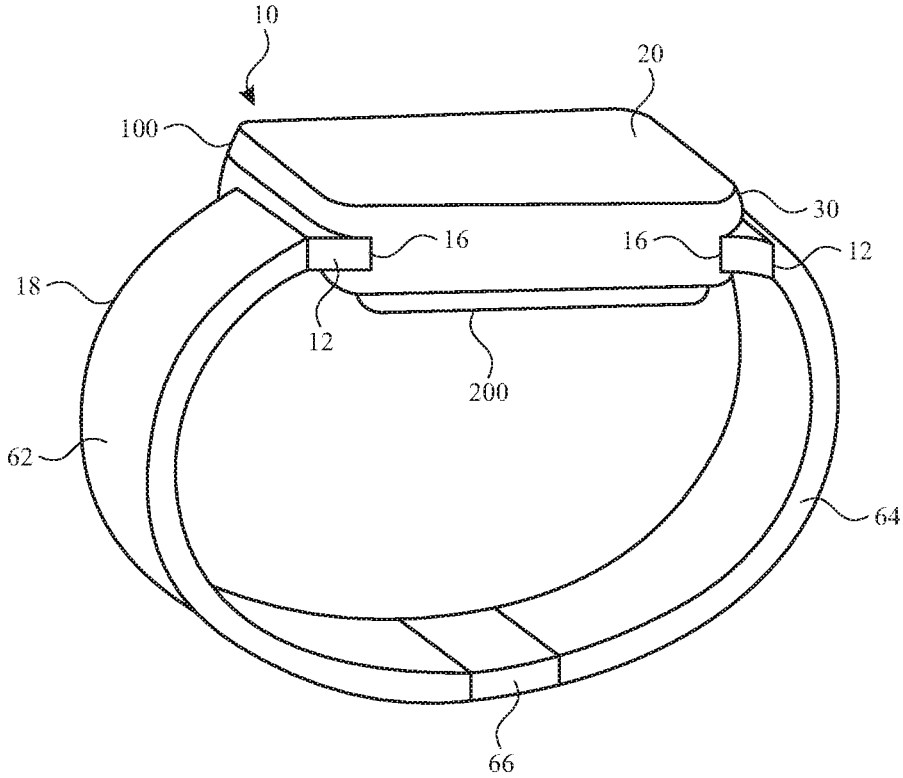
FIG. 2 illustrates a perspective view of a watch, in accordance with some embodiments of the present disclosure.

FIG. 2 illustrates a watch 10 including the watch body 100 that is useable with a functional module 200, according to one or more embodiments of the present disclosure.

The watch body 100 can include one or more I/O systems. For example, the watch body 100 can include a display 20 configured to output various information about the watch 10. The display 20 of the watch body 100 can also be configured to receive touch input from a user. The watch body 100 can also have other input and output mechanisms. For example, the watch body 100 can include or interface with one or more buttons, a crown, keys, dials, trackpads, microphones and the like.

The watch body 100 can include a watch housing 30 and one or more attachment units 12 capable of being removably coupled to the watch housing 30. The watch housing 30 serves to surround a peripheral region of the watch body 100 as well as support the internal components of the watch body 100 in their assembled position. For example, the watch housing 30 encloses and supports various internal components (including for example integrated circuit chips, processors, memory devices and other circuitry) to provide computing and functional operations for the watch 10.

The watch 10 can utilize a watch band 18 for attaching the watch 10 to a wrist. For example, as shown in FIG. 2, the watch band 18 can include a first band strap 62 attached to a first attachment unit 12 of the watch 10 and a second band strap 64 attached to a second attachment unit 12 of the watch 10. In some embodiments, free ends of the first band strap 62 and the second band strap 64 can be configured to be releasably attached or secured to one another using a clasp 66 or other attachment mechanism to form a loop. This loop can then be used to attach the watch 10 to a user's wrist.

Although a single attachment unit 12 is discussed herein, a plurality of attachment units 12 can be coupled to the housing 30. When multiple attachment units 12 are used, as shown in FIG. 2, the watch housing 30 can have a band retaining feature 16 (e.g., channel, latch, clip, recess, lock or other such coupling node) on a first side and a second side, opposite the first side, of the body 100. While the band retaining feature 16 of FIG. 2 is shown as a channel, it will be understood that other retention mechanisms can be applied. The band retaining feature 16 on the first side of the body 100 of the watch housing 30 can receive one of the attachment units 12 and the band retaining feature 16 on the second side of the body 100 of the watch housing 30 can receive another attachment unit 12. The attachment units 12 can have a same or different size and/or shape, wherein the size and/or shape corresponds to a size and/or shape of the respective band retaining feature 16. As shown in FIG. 2, the body 100 includes one or more band retaining features 16 that mechanically engage a corresponding attachment unit 12. The band retaining features 16 on the body 100 include an opening while the attachment unit 12 includes a lug that fits within the opening. The opening can be configured in a variety of different shapes and orientations. While a first band strap 62 and/or a second band strap 64 can be removably connected to a watch housing 30, it will be understood that the first band strap 62 and/or the second band strap 64 can be fixed attached to or integrally formed with a housing 30.

Systems of the present disclosure provide a watch with exchangeable modules that provide a variety of different components and functions to achieve the results that are desired by a user. The modular configurations allow a user to easily customize a watch with one or more functional modules to provide features that integrate with other operations of the body of the watch. The functional modules can be easily exchanged with each other to provide different components and functions at different times.

As used herein, "modular" or "module" can refer to a characteristic that allows an item, such as a functional module, to be connected, installed, removed, swapped, and/or exchanged by a user in conjunction with another item, such as a body of a watch. Connection of a module with a body can be performed and reversed, followed by disconnection and connection of another module with the same body or another body with the same module. As such, multiple modules can be exchangeable with each other with respect to a given body. Further, multiple bodies can be exchangeable with each other with respect to a given module. An item can be module for ease of exchange by a user. Additionally or alternatively, while an item may be modular at one stage (e.g., during production), it will be understood that an item or set of items can be made to be non-modular (e.g., after production), so that a user cannot exchange modules with the same ease as is provided to a manufacturer.

A module can be connected to a body in a manner that allows the module to be removed thereafter. The connection can be fully reversible, such that when the module and the body are disconnected, each is restored to a condition held prior to the connection. The connection can be fully repeatable, such that after the module and the body are disconnected, the same or a different body and module pair can be connected in the same way. The module and body can be securely and temporarily connected, rather than permanently, fixedly, or resiliently connected (e.g., via chemical and/or molecular bond). For example, connection and disconnection of the module and body are facilitated in a manner that does not cause permanent damage, harm, or deformation to the module or the body.

A module can be connected to and disconnected from a body with ease by a user. The connection and/or disconnection can be achieved repeatedly and reversibly by hand, rather than requiring a tool. For example, a locking mechanism and/or a release mechanism can be provided on the module and/or the body for ready access by a user. A force required by a user to connect and/or disconnect the module and the body can be within a typical range for a user's fingers. For example, a force required to connect and/or disconnect the module and the body can be less than 1 N, 5 N, 10 N, 15 N, 20 N, 25 N, or 30 N. Additionally or alternatively, connection and/or disconnection can be achieved and/or facilitated by use of a tool.

A module and a body can be connected in a manner that secures the relative positions of the module and the body with respect to each other. The module and the body can be connected in a manner that provides a communication link there between. The secured positions and the communication link can both be achieved and maintained upon connection of the module and the body. The secured positions and the communication link can both be removed upon disconnection of the module from the body.

While different modules can provide different features and/or functions, multiple modules can be exchangeable with each other by providing at least some features that are similar or the same among the multiple modules. For example, different modules can be secured to a given body by the same securement mechanism. By further example, different modules can establish a communication link with the given body via the same communication mechanism. Accordingly, a body can accommodate the exchange of different modules by providing the same securement mechanism and communication mechanism across the different modules. Likewise, a module can accommodate the exchange of different bodies by providing the same securement mechanism and communication mechanism across the different bodies.

Multiple modules can have other features that are similar or the same among the multiple modules. For example, the multiple modules can include enclosures that have the same or similar size, shape, profile, dimension, aspect ratio, surface feature, texture, color, and/or markings. The common features allow a user to exchange the modules with each other while maintaining a consistent user experience across the different modules when used at different times. Additionally or alternatively, at least one of the size, shape, profile, dimension, aspect ratio, surface feature, texture, color, and/or markings can be different among multiple modules.

Figure 3:
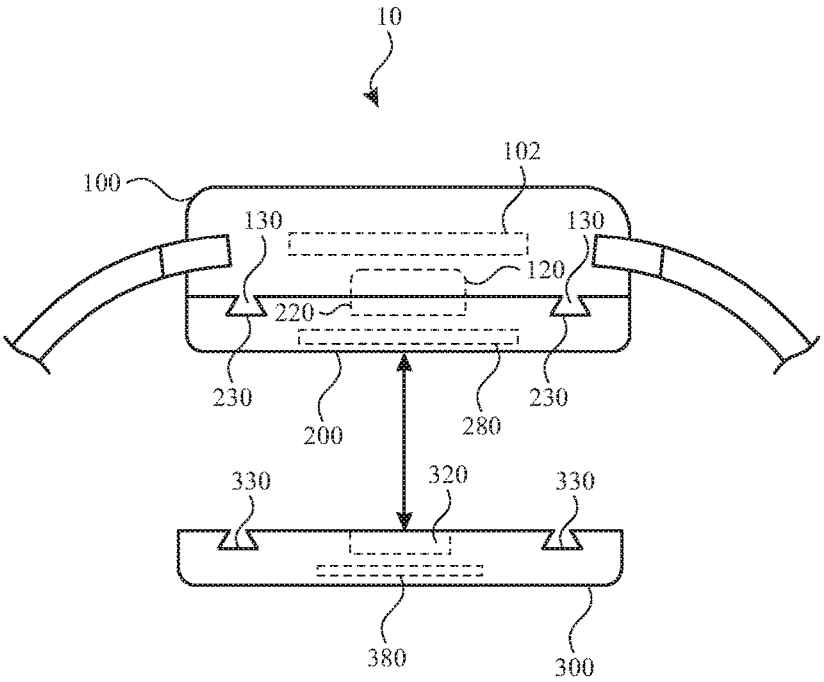
FIG. 3 illustrates a side view of a system including a watch body and multiple functional modules, in accordance with some embodiments of the present disclosure.

One of a variety of functional modules can be used at different times with a given body of a watch. FIG. 3 illustrates a side view of a system including a watch body and multiple functional modules, in accordance with some embodiments of the present disclosure.

As shown in FIG. 3, a system can include a body 100 and one or more functional modules 200 and 300. It should be appreciated however that any number of bodies and functional modules may be provided. Each of functional modules 200 and 300 may be configured differently. For example, the functional aspects and the aesthetic aspects may be configured differently. The first functional module 200 may have a first component 280, and the second functional module 300 may have a second component 380. Additional functional modules can also have the same or different components. The different components 280 and 380 can provide different functions, as discussed further herein, so that attachment of a given functional module provides different functions to the same body 100 of the watch. Each functional module can include one or more functional components such as sensors, bio-sensors, batteries, I/O components, communication interfaces, controllers, and the like, as discussed further herein.

It will be recognized that the difference in functionality can refer to both the purpose of a component as well as the parameters of its operation. For example, while the components of different functional modules can both be for a common purpose, the components can operate differently to achieve the purpose. For example, different components can be for sensing a biometric characteristic, such as heart rate. However, the different components can be calibrated differently based on the user. By further example, where heart rate relies on transmission and reflection of light (e.g., PPG sensor), each bio-sensor can be optimized for a particular pigmentation or range of pigmentations of skin, so that a given user can select the functional module that is best suited for operation with the user. Other variations, such as size, shape, and material selection can be provided so the user can select the functional module that is best suited for the user's comfort and/or performance of the component.

The different functional modules can also differ in mechanical configuration such as material properties and/or structural features, which can help define shape, size, flexibility, rigidity, tactile feel, ergonomic features, and/or aesthetic properties such as color, patterns, and/or materials to provide a different look and feel. Furthermore, each of the functional modules may have a different enclosure having a different color, material, shape, accoutrements, patterns, etc. The enclosures can provide different aesthetic features, cosmetic features, and/or a look and feel than the other enclosures in the system.

While the components 280 and 380 of the functional modules 200 and 300 can differ, the functional modules 200 and 300 can have the same or similar module attachment elements 230 and 330, so that each of the functional modules 200 and 300 can attach to the body 100 via the body attachment elements 130 in the same or similar manner. Furthermore, the functional modules 200 and 300 can have the same or similar module communication interfaces 220 and 320, so that each of the components 280 and 380 can communicate with the body 100 via the body communication interface 120 in the same or similar manner.

Accordingly, each functional module is configured to provide a different function and/or aesthetic feature than one or more other functional modules in the system. As such, the user can select the functional module with the desired functionality and/or look and feel. This may be at the time of purchase, thus allowing differentiation from other purchasers, or it may be that all or some portion of the functional modules come in a set such that the user can select the desired functional modules for the right moment. In one example, one functional module may be configured for exercise (e.g., with sensors and/or bio-sensors), while another may be configured for a regular use (e.g., with an auxiliary battery and/or cosmetic features). Any combination of aesthetic and functional features may be provided to create a different watch. When combined with the different bodies, the system becomes highly customizable. The user can create a different watch by selecting one body to go along with one functional module. If multiple systems are provided, any number of different watch configurations can be made.

A user having access to multiple functional modules and/or multiple bodies can have a variety of options by combining different pairings of functional modules and bodies. Additionally or alternatively, a provider of watches can provide a variety of functional modules and/or bodies that can be selected by a user at a point of sale. A user can select one or more functional modules and one or more bodies when placing an order. The provider can combine the one or more functional modules and one or more bodies to assemble a custom watch according to the user's order. The watch can then be provided to the user with the one or more functional modules and one or more bodies as desired.

Figure 4:
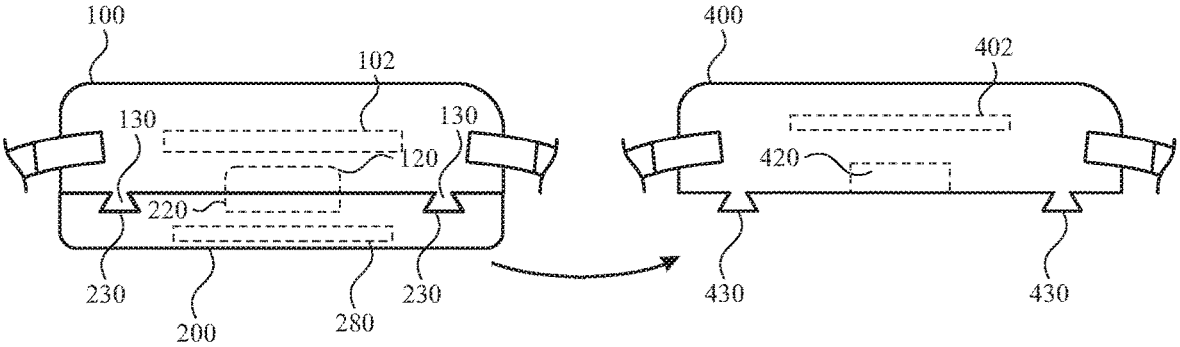
FIG. 4 illustrates a side view of a system including multiple watch bodies and a functional module, in accordance with some embodiments of the present disclosure.

A given functional module can be used with one of a variety of watch bodies. FIG. 4 illustrates a side view of a system including multiple watch bodies and a functional module, in accordance with some embodiments of the present disclosure.

As shown in FIG. 4, a system can include one or more bodies 100 and 400 and a functional module 200. It should be appreciated however that any number of bodies and functional modules may be provided. Each of the bodies 100 and 400 may be configured differently. For example, the functional aspects and the aesthetic aspects may be configured differently. The first body 100 may have a first controller 102, and the second body 400 may have a second controller 402. Additional bodies can also have the same or different components. The different controllers and/or other components can provide different functions, as discussed further herein, so that use of a given body provides different functions for the watch.

The different bodies can also differ in mechanical configuration such as material properties and/or structural features, which can help define shape, size, flexibility, rigidity, tactile feel, ergonomic features, and/or aesthetic properties such as color, patterns, and/or materials to provide a different look and feel. Furthermore, each of the bodies may have a different housing having a different color, material, shape, accoutrements, patterns, etc. The housings can provide different aesthetic features, cosmetic features, and/or a look and feel than the other housings in the system.

While the controllers 102 and 402 and/or other components the bodies 100 and 400 can differ, the bodies 100 and 400 can have the same or similar body attachment elements 130 and 430, so that each of the bodies 100 and 400 can attach to the functional module 200 via the module attachment elements 230 in the same or similar manner. Furthermore, the bodies 100 and 400 can have the same or similar body communication interfaces 120 and 420, so that each of the controllers 102 and 402 can communicate with the functional module 200 via the module communication interface 220 in the same or similar manner.

Accordingly, each body is configured to provide a different function and/or aesthetic feature than one or more other bodies in the system. As such, the user can select the body with the desired functionality and/or look and feel. This may be at the time of purchase, thus allowing differentiation from other purchasers, or it may be that all or some portion of the bodies come in a set such that the user can select the desired bodies for the right moment. Any combination of aesthetic and functional features may be provided to create a different watch. When combined with the different functional modules, the system becomes highly customizable. The user can create a different watch by selecting one body to go along with one functional module. If multiple systems are provided, any number of different watch configurations can be made.

Figure 5:
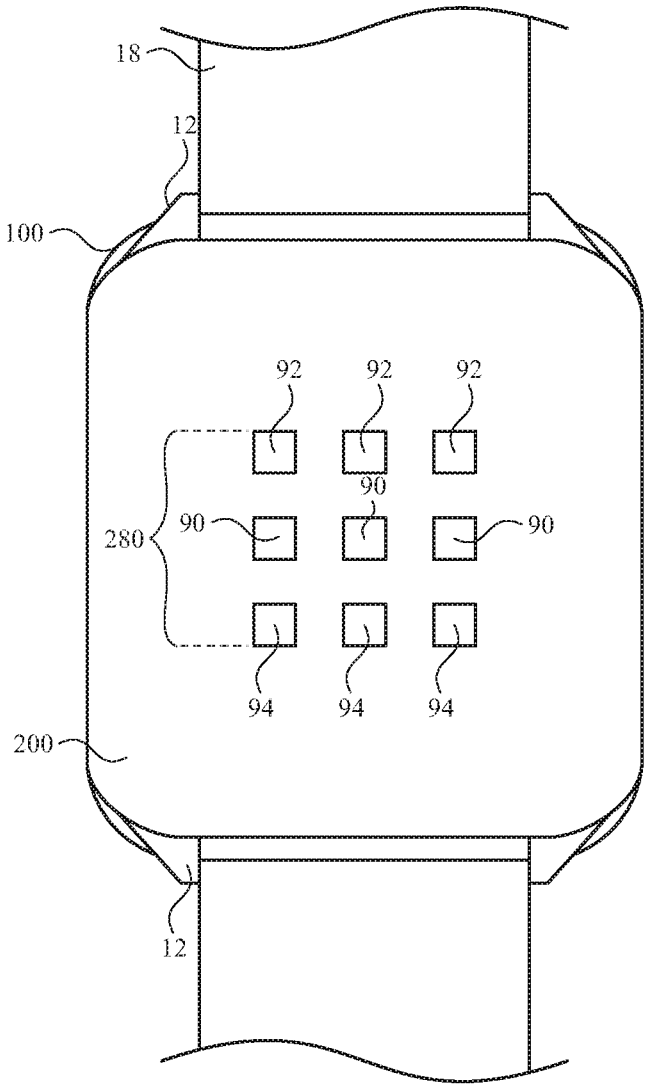
FIG. 5 illustrates a rear view of a watch, in accordance with some embodiments of the present disclosure.

FIG. 5 illustrates a rear view of a watch 10 according to one or more embodiments of the present disclosure. The functional module 200 or multiple functional modules can be attached to the body 100. The functional module 200 can be positioned over a portion of the body 100 of the watch. For example, the functional module 200 can cover the body 100 on one side thereof (e.g., at least 10%, 20%, 30%, 40%, 50%, 60%, 70%, 80%, or 90% or up to 100% of a surface area on an inner side of the body 100). The functional module 200 can extend between and/or approximately from one band retaining feature to another band retaining feature. The functional module 200 can provide an entirety of the surface of the watch 10 that is contacted by the wrist of the user when the watch is worn. The functional module 200 can have a surface that generally conforms to an adjacent surface of the body 100. The functional module 200 can further provide an outer profile that accommodates use on the wrist. For example, where the functional module 200 is attachable between the body 100 and the wrist of the user, the functional module 200 can have an outer profile that generally conforms to the wrist of the user.

The functional module 200 can provide a structure that protects its contents. For example, the functional module 200 can include a housing that is rigid and not subject to flexing and/or deformation during normal use while being worn. By further example, the outer housing of the functional module 200 can be more rigid than the watch band, so that the body 100 and the functional module 200 remain locked together during use and the watch band conforms to the wrist of the user to secure the watch to the user.

While the functional module 200 is depicted in FIG. 5 as being on an inner surface of the body 100, such that the functional module 200 faces and/or contacts the wrist of the user when the watch is worn, it will be understood that the functional module 200 can be positioned at other locations on the body 100. For example, the functional module 200 can be positioned partially or entirely on an inner side, an outer side, or a lateral side that joins the inner side of the body 100 to the outer side of the body 100.

The functional module 200 can include one or more components 280 that provide communication, access, or other functions on or through the functional module 200. While selected components 280 are depicted in FIG. 5, it will be understood that one or more of a variety of components, including electronic components, can be provided by the functional module 200, as discussed further herein. The components 280 of different functional modules 200 can have different features to provide different functions available to the user when attached to the body 100. The user can then select the functional module 200 corresponding to the desired function. For example, the components 280 can include one or more sensors, one or more health sensors, one or more environmental sensors, one or more batteries, one or more communication components, one or more I/O components, one or more communication interfaces, and/or one or more audio devices, one or more optical devices, and/or one or more haptic devices. The components 280 can include circuitry and/or structures to support the functions provided by the components 280.

The components 280 can include one or more windows 90, one or more electrodes 92, and/or one or more other electronic components 94. While the components 280 of FIG. 5 are represented as squares aligned in a grid pattern, it will be understood that the components 280 can be of any size, shape, and/or arrangement. For example, the components 280 can be square, rectangular, polygonal, round, curved, arcuate, circular, semi-circular, flat, or another shape. The components 280 (e.g., windows 90, electrodes 92, and/or electronic components 94) can be the same size, different sizes, the same shape, or different shapes. The components 280 (e.g., windows 90, electrodes 92, and/or electronic components 94) can be distributed in a pattern or another arrangement along the surface of the functional module 200. At least a pair of the components 280 of one type (e.g., windows 90, electrodes 92, and electronic components 94) can be separated from each other by components 280 of another type. One or more of the components 280 (e.g., windows 90, electrodes 92, and electronic components 94) can partially or entirely surround another one or more of the components 280 (e.g., windows 90, electrodes 92, and electronic components 94). For example, at least some of the electrodes 92 can partially or entirely surround one or more of the windows 90 and/or electronic components 94. At least some of the windows 90 can partially or entirely surround one or more other windows 90. For example, one or more central windows 90 can be used to transmit light in one direction, and other surrounding windows 90 can be used to transmit light in another direction. Additionally or alternatively, the windows 90 can partially or entirely surround one or more of the electrodes 92 and/or electronic components 94. The components 280 can extend along an inner and/or outer surface of the functional module 200 and/or extend into or through the width of the functional module 200 (e.g., between and to opposing sides of the functional module 200).

The functional module 200 can provide one or more windows 90 forming optical pathways to transmit light to and/or from a sensor of the functional module 200 and/or of the body 100. With light transmitted through the windows 90, an optical (e.g., PPG) sensor or sensors can be used to compute various biometric characteristics including, without limitation, a heart rate, a respiration rate, blood oxygenation level, a blood volume estimate, blood pressure, or a combination thereof. The windows 90 can form an opening, a transmission medium, an optical filter, and/or a lens. It will be appreciated that any number of windows 90 can be provided. One or more windows 90 can provide transmission of light from a light-emitting device within the functional module 200 and/or of the body 100. One or more windows 90 can provide transmission of light to a light-detecting device (e.g., sensor) within the functional module 200 and/or of the body 100. The windows 90 can be of any size, shape, and arrangement. For example, the windows 90 can be arranged to align with a sensor and/or a target region or regions of the user when the watch is worn by the user.

Additionally or alternatively, the functional module 200 can provide one or more electrodes 92 to provide an electrically conductive pathway through or along the functional module 200. The electrodes 92 can be operated to perform an electrical measurement, for example, to measure electrocardiographic (ECG) characteristics, galvanic skin resistance, and other electrical properties of the user's body and/or the environment. It will be appreciated that any number of electrodes 92 can be provided. Each electrode 92 can be insulated from other electrodes 92 and/or other components of the watch. One or more electrodes 92 can operate as a first terminal, and one or more electrodes 92 can operate as an additional terminal. The electrodes 92 can be of any size, shape, and arrangement. For example, the electrodes 92 can be arranged to align with a target region or regions of the user when the watch is worn by the user.

Additionally or alternatively, the functional module 200 can provide one or more other electronic components 94 providing other functionality. The one or more electronic components 94 can provide of facilitate measurements of body temperature, exposure to UV radiation, and other health-related information. The one or more electronic components 94 can provide or facilitate measurements of body temperature, exposure to UV radiation, and other health-related information. The one or more electronic components 94 can be configured to provide or facilitate detection of images, pressure, light, touch, force, temperature, position, motion, and so on. The one or more electronic components 94 can include or facilitate operation of a temperature sensor, a light or optical sensor, an atmospheric pressure sensor, a humidity sensor, a magnet, a gyroscope, an accelerometer, and so on. The one or more electronic components 94 can include an opening extending partially or entirely through the functional module 200 to provide exposure to an external environment, for example, for measurements.

Figure 6:
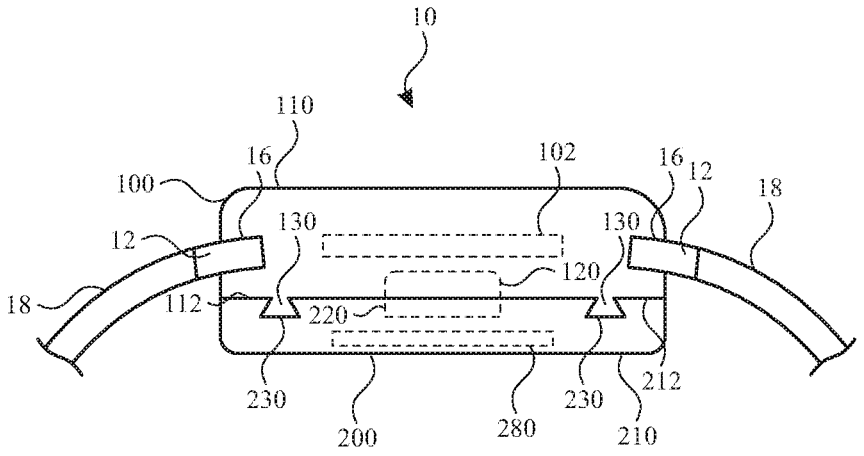
FIG. 6 illustrates a side view of a watch, in accordance with some embodiments of the present disclosure.

FIG. 6 illustrates a side view of a watch 10, in accordance with some embodiments of the present disclosure. As shown in FIG. 6, the watch body 100 includes the housing 30 having an outer side 110 and an inner side 112 opposite the outer side 110. The outer side 110 faces away from a wrist of the user when the watch 10 is worn, and the inner side 112 faces toward the wrist of the user when the watch 10 is worn. The body can include a controller 102 for controlling operations of the body 100 and/or the functional module 200.

The functional module 200 is attachable, for example, to the inner side 112 of the housing 30. When the functional module 200 is attached to the housing 30, the electronic component 280 of the functional module 200 is operably connected to the controller 102 of the body 100. As shown in FIG. 6, the functional module 200 includes an enclosure having an outer side 210 and an inner side 212 opposite the outer side 210. The inner side 212 faces toward the body 100 and away from a wrist of the user when the watch 10 is worn. The outer side 210 faces away from the body 100 and toward the wrist of the user when the watch 10 is worn.

For example, the body 100 can include one or more body attachment elements 130, and the functional module 200 can include one or more module attachment elements 230. The body attachment elements 130 and the module attachment elements 230 facilitate mechanical coupling or connection of the body 100 and the functional module 200. The body attachment elements 130 and the module attachment elements 230 can include one or more of a variety of features, as discussed further herein. While protrusions and grooves are depicted in FIG. 6, it will be recognized that other attachment and securement features, such as locks, latches, snaps, screws, clasps, threads, magnets, and/or pins can be included on the body 100 and/or the functional module 200 for securely attaching the functional module 200 to the body 100.

By further example, the body 100 can include one or more body communication interfaces 120, and the functional module 200 can include one or more module communication interfaces 220. The body communication interfaces 120 and the module communication interfaces 220 facilitate a communication link between the body 100 and the functional module 200. The body communication interfaces 120 and the module communication interfaces 220 can include one or more of a variety of features, as discussed further herein. While simple blocks are depicted in FIG. 6, it will be recognized that one or more of a variety of communication links can be provided, such as electrical connectors, pogo pins, conductive surfaces, wireless receivers/transmitters, and/or inductive coupling features (e.g., coils) can be included with the body 100 and/or the functional module 200 for communicably coupling the electronic component 280 of the functional module 200 to the controller 102 of the body 100.

As shown in FIG. 6, the body 100 can include the band retaining features 16 on opposing sides of the housing 30 for releasably connecting the body 100 to a watch band 18 via the attachment units 12.

Figure 7:
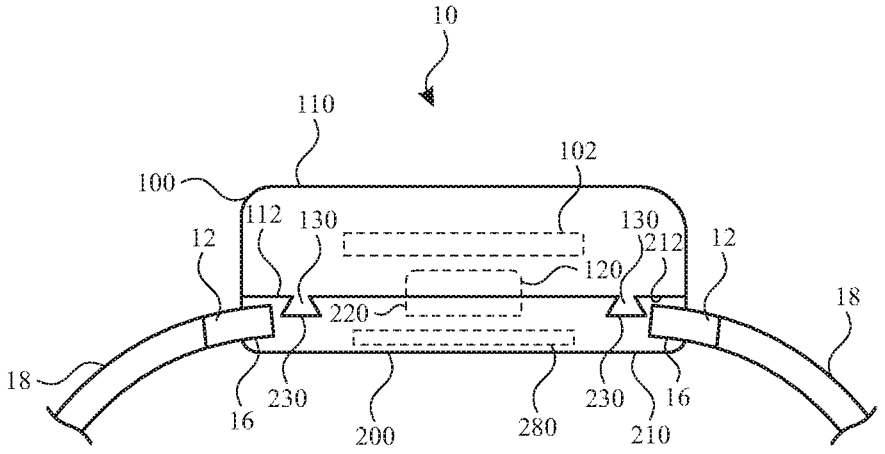
FIG. 7 illustrates a side view of a watch, in accordance with some embodiments of the present disclosure.
Figure 8:
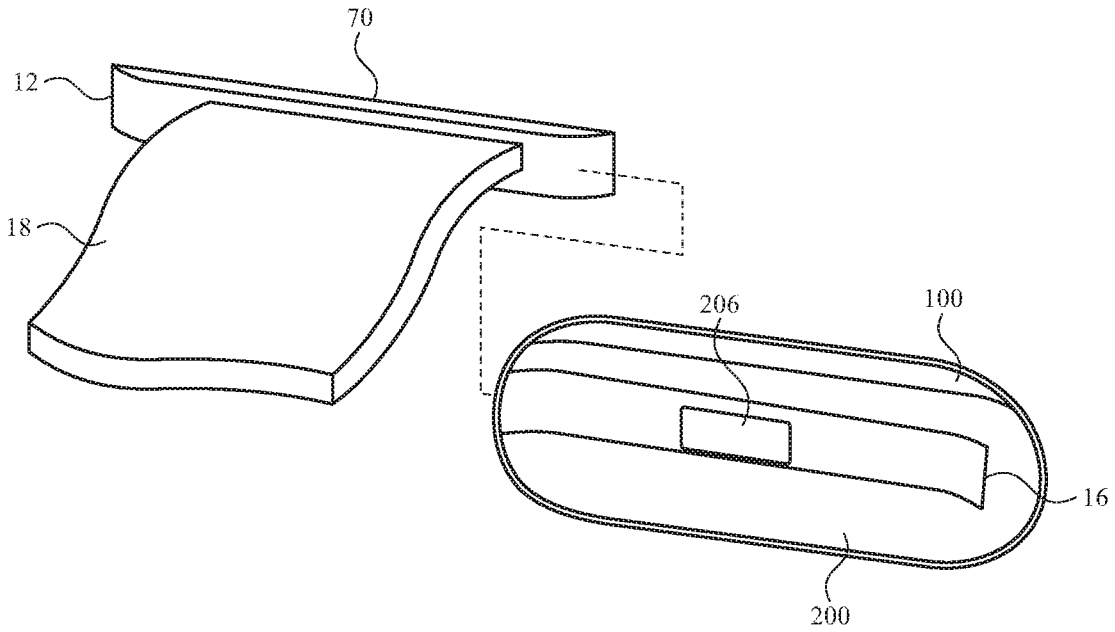
FIG. 8 illustrates a perspective view of a functional module and a watch band, in accordance with some embodiments of the present disclosure.

A connection to the watch band 18 can be provided by the functional module 200. As shown in FIG. 7, the functional module 200 can include the band retaining features 16 on opposing sides thereof for releasably connecting the functional module 200 to the watch band 18 via the attachment units 12. The body 100 can be attached to the functional module 200. For example, as described herein, the body attachment elements 130 and the module attachment elements 230 can facilitate mechanical coupling or connection of the body 100 and the functional module 200, and the body communication interfaces 120 and the module communication interfaces 220 can facilitate a communication link between the body 100 and the functional module 200.

Where the watch band 18 includes electronic components, the functional module 200 can provide a communication link between the watch band 18 and the body 100. FIG. 8 illustrates a perspective view of a connection mechanism, according to some embodiments of the present disclosure. As shown in FIG. 8, the attachment unit 12 can be laterally or otherwise inserted into the functional module 200. As such, the attachment unit 12 can be configured to slide relative to the functional module 200. Additionally or alternatively, the attachment unit 12 can be pressed, snap fit or otherwise forwardly inserted into the band retaining feature 16 of the functional module 200. Once inserted, the attachment unit 12 can be locked or otherwise secured within the functional module 200. An electrical connection can be made and maintained upon mechanical securement of the watch band 18 to the functional module 200. The functional module 200 can include a communication interface 206, for example, within band retaining feature 16. The attachment unit 12 of the watch band 18 can include a band communication interface 70 for electrically connecting to the communication interface 206 when the attachment unit 12 is connected to the band retaining feature 16. For example, the band communication interface 70 and/or the communication interface 206 can include pogo pins or other conductive surfaces for mutual contact and electrical connection. When the watch band 18 is connected to the functional module 200, the controller 102 can be operably connected to the watch band 18 via the communication interface 206. The controller 102 can then communicate with and/or control the watch band 18 and/or components thereof, such as sensors.

Figure 9:
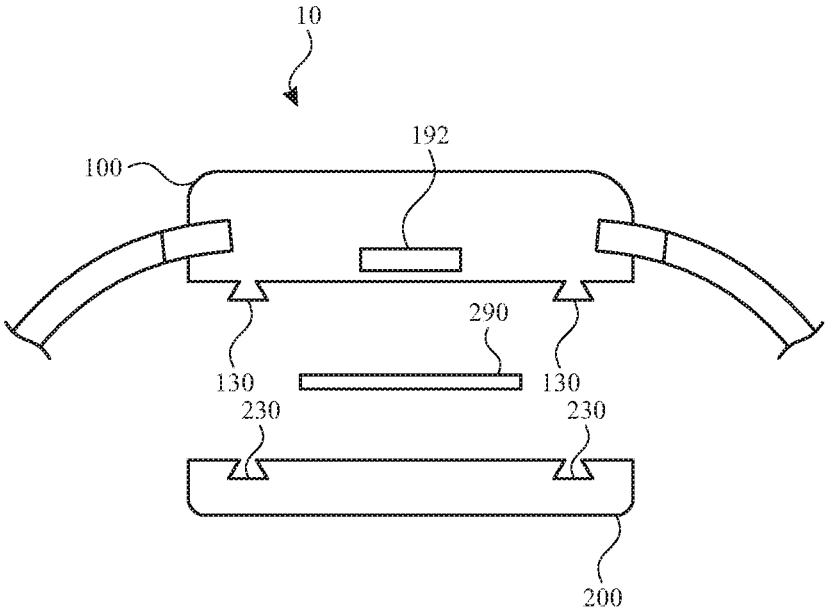
FIG. 9 illustrates a side exploded view of a watch, in accordance with some embodiments of the present disclosure.
Figure 10:
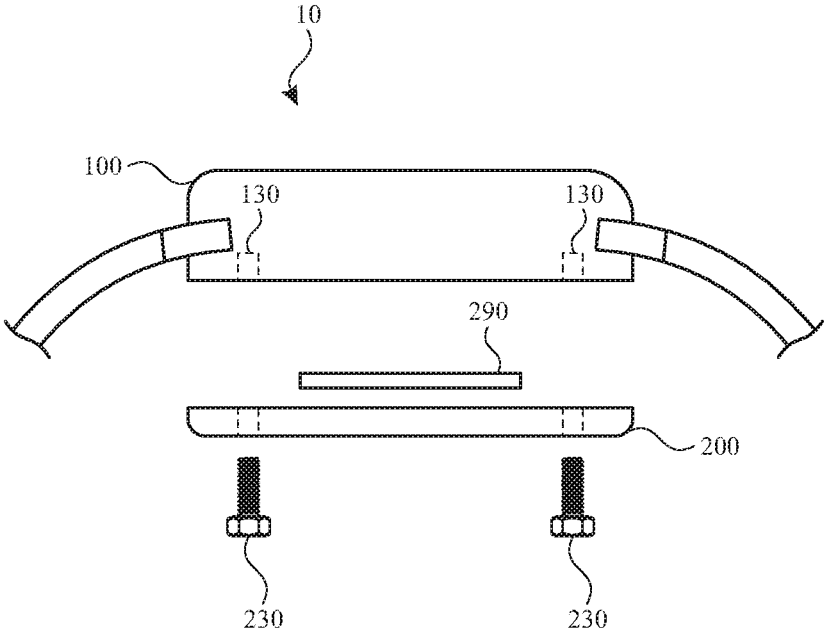
FIG. 10 illustrates a side exploded view of a watch, in accordance with some embodiments of the present disclosure.

FIGS. 9-10 illustrate side exploded views of watches each having a mechanical attachment mechanism, in accordance with some embodiments of the present disclosure. While various mechanical attachment mechanisms are depicted, it will be understood that other mechanical attachment mechanisms are contemplated.

As shown in FIG. 9, the functional module 200 can attach to the body 100 of the watch 10 with the body attachment elements 130 and the module attachment elements 230. For example, the body attachment elements 130 and the module attachment elements 230 can mechanically engage each other for securement of the functional module 200 to the body 100. The body attachment elements 130 and the module attachment elements 230 can have complementary shapes to facilitate engagement. For example, the body attachment elements 130 and/or the module attachment elements 230 can form a protrusion and the module attachment elements 230 and/or the body attachment elements 130 can form a groove. The groove can have a shape and/or size that complement the shape and/or size of the body attachment elements 130. The protrusions can slide in a direction within the grooves until the functional module 200 is fully attached to the body 100. It will be understood that a variety of shapes and/or sizes can be provided to achieve the engagement between the body attachment elements 130 and the module attachment elements 230. It will be further understood that any number of body attachment elements 130 and module attachment elements 230 can be provided.

Additional or alternative mechanisms can be provided to lock the functional module 200 in place with respect to the body 100. For example, mechanisms such as locks, latches, snaps, screws, clasps, threads, magnets, and/or pins can be included to lock the functional module 200 to the body 100 when the body attachment elements 130 and the module attachment elements 230 engage each other. The functional module 200 can remain locked from sliding with respect to the body 100 until a release mechanism 192 is actuated. The release mechanism 192 can be provided on an outer surface of the watch 10 for access by a user. For example, the release mechanism 192 can be provided on an outer surface of the body 100 and/or the functional module 200. Where a locking mechanism locks the functional module 200 in place with respect to the body 100, the release mechanism 192, when actuated, can move and act upon the locking mechanism to cause it to release. For example, the release mechanism 192, when actuated, can release one or more locks, latches, snaps, screws, clasps, threads, magnets, and/or pins that were previously locking the functional module 200 to the body 100. At least some of the interactions between the release mechanism 192 and a locking mechanism can be within the body 100 and/or the functional module 200.

As further shown in FIG. 9, a seal member 290 (e.g., gasket) can be provided between the body 100 and the functional module 200. When the body 100 and the functional module 200 are joined together, the body 100 and the functional module 200 can define a space there between. The seal member 290 can surround the space and form a watertight seal to protect components within the space.

As shown in FIG. 10, the functional module 200 can attach to the body 100 of the watch 10 with threaded screws or other fasteners. For example, the body attachment elements 130 can include threaded receptacles and the module attachment elements 230 can include threaded screws. The screws can extend through the functional module 200 to engage the receptacles. It will be further understood that any number of screws and receptacles can be provided. As further shown in FIG. 10, the seal member 290 can be provided between the body 100 and the functional module 200.

Figure 11:
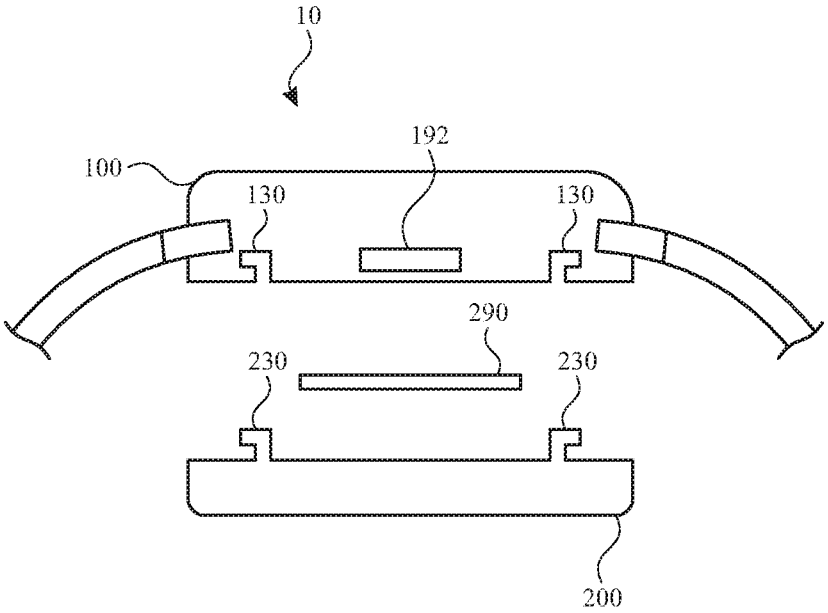
FIG. 11 illustrates a side exploded view of a watch, in accordance with some embodiments of the present disclosure.

As shown in FIG. 11, the functional module 200 can attach to the body 100 of the watch 10 with a twist mechanism. For example, the body attachment elements 130 and/or the module attachment elements 230 can form a curved protrusion (e.g., threads) and the module attachment elements 230 and/or the body attachment elements 130 can form a curved groove (e.g., threads). The curved protrusions can rotate about an axis and within the grooves until the functional module 200 is fully attached to the body 100. Additional or alternative mechanisms can be provided to lock the functional module 200 in place with respect to the body 100. For example, mechanisms such as locks, latches, snaps, screws, clasps, threads, magnets, and/or pins can be included to rotationally lock the functional module 200 to the body 100 when the body attachment elements 130 and the module attachment elements 230 engage each other. The functional module 200 can remain rotationally locked with respect to the body 100 until the release mechanism 192 is actuated. As further shown in FIG. 11, the seal member 290 can be provided between the body 100 and the functional module 200.

Figure 12:
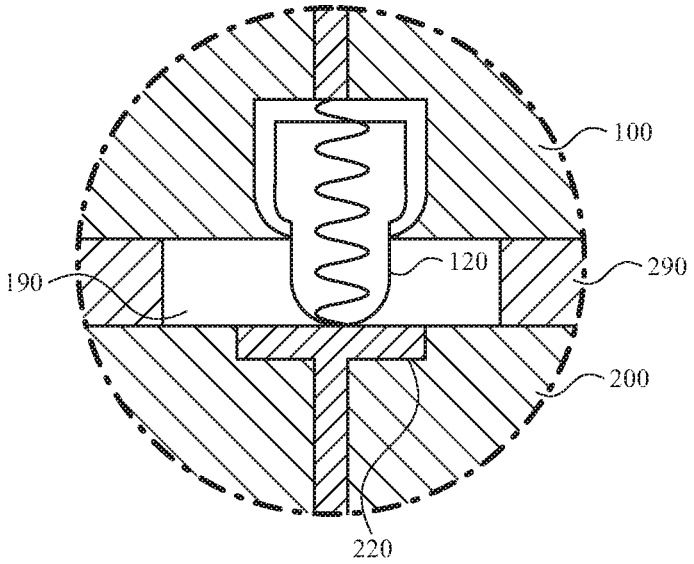
FIG. 12 illustrates a sectional view of a watch, in accordance with some embodiments of the present disclosure.
Figure 13:
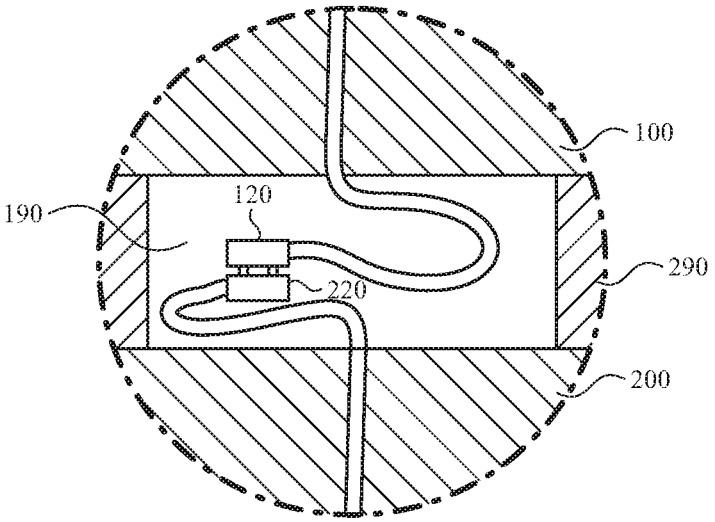
FIG. 13 illustrates a sectional view of a watch, in accordance with some embodiments of the present disclosure.

FIGS. 12 and 13 illustrate sectional views of watches each having a communication link, in accordance with some embodiments of the present disclosure. While various communication links are depicted, it will be understood that other communication links are contemplated.

As shown in FIG. 12, the body communication interface 120 and/or the module communication interface 220 can include a pogo pin or another moveable element for making an electrical connection. The pogo pin can be at least partially collapsible. For example, the pogo pin can include a spring or another elastic element and two or more interlocking slidable members. A contact pad opposite the pogo pin can be partially flexible. For example, the contact pad of the module communication interface 220 can be formed from an electrically conductive foam or elastomer. In other cases, the contact pad of the module communication interface 220 can include pogo pin geometry in addition to and/or separate from pogo pin geometry of the body communication interface 120. While FIG. 12 depicts a pogo pin as the body communication interface 120 and a contact pad as the module communication interface 220, it will be understood that, additionally or alternatively, the body communication interface 120 and the module communication interface 220 can be exchanged.

As shown in FIG. 13, the body communication interface 120 and/or the module communication interface 220 can include a connector that extends from the corresponding structure. The connectors can allow a user to connect the body communication interface 120 to the module communication interface 220. For example, the user can manually connect the body communication interface 120 to the module communication interface 220 prior to attaching the body 100 to the functional module 200. The electrical connectors can each include a flex circuit and/or a zero insertion force (ZIF) connector. For example, one end can include a mechanical latching mechanism that clamps down onto exposed traces of the other end. While FIG. 13 depicts a pair of connectors, it will be understood that other configurations are contemplated. For example, only one of the body communication interface 120 and the module communication interface 220 can extend from the corresponding structure for direct insertion into the opposing structure. Additionally or alternatively, the connectors can include ZIF connectors, non-ZIF connectors, slider connectors, flip actuator connectors, and/or FPC-to-Board connectors. Additionally or alternatively, the body communication interface 120 and/or the module communication interface 220 can provide direct (e.g., board-to-board) connection between the controller of the body 100 and the electronic component of the functional module 200.

As further shown in FIGS. 12 and 13, the body 100 and the functional module 200 can form a space 190 within which the body communication interface 120 connects to the module communication interface 220. The seal member 290 can define a portion of a boundary of the space 190, so that the space 190 is an enclosed space with a water-tight seal to protect components within the space 190.

When the functional module 200 is attached to the body 100, the body attachment element 130 and the module attachment element 230 form a seal to enclose the space 190. At the same time, the controller of the body 100 is operably connected to the electronic component of the functional module 200 via the body communication interface 120 and the module communication interface 220 within the space 190. The electrical connection and the seal can be maintained until the release mechanism is actuated.

It will be understood that a variety of other communication links can be provided between the body communication interface 120 and the module communication interface 220. No direct contact may be required to establish a communication link. For example, a communication link between the body communication interface 120 and the module communication interface can include wireless interfaces, Bluetooth interfaces, Near Field Communication interfaces, magnetic interfaces, inductive interfaces, resonant interfaces, capacitive coupling interfaces, Wi-Fi interfaces, optical interfaces, acoustic interfaces, and/or other communication interfaces.

Figure 14:
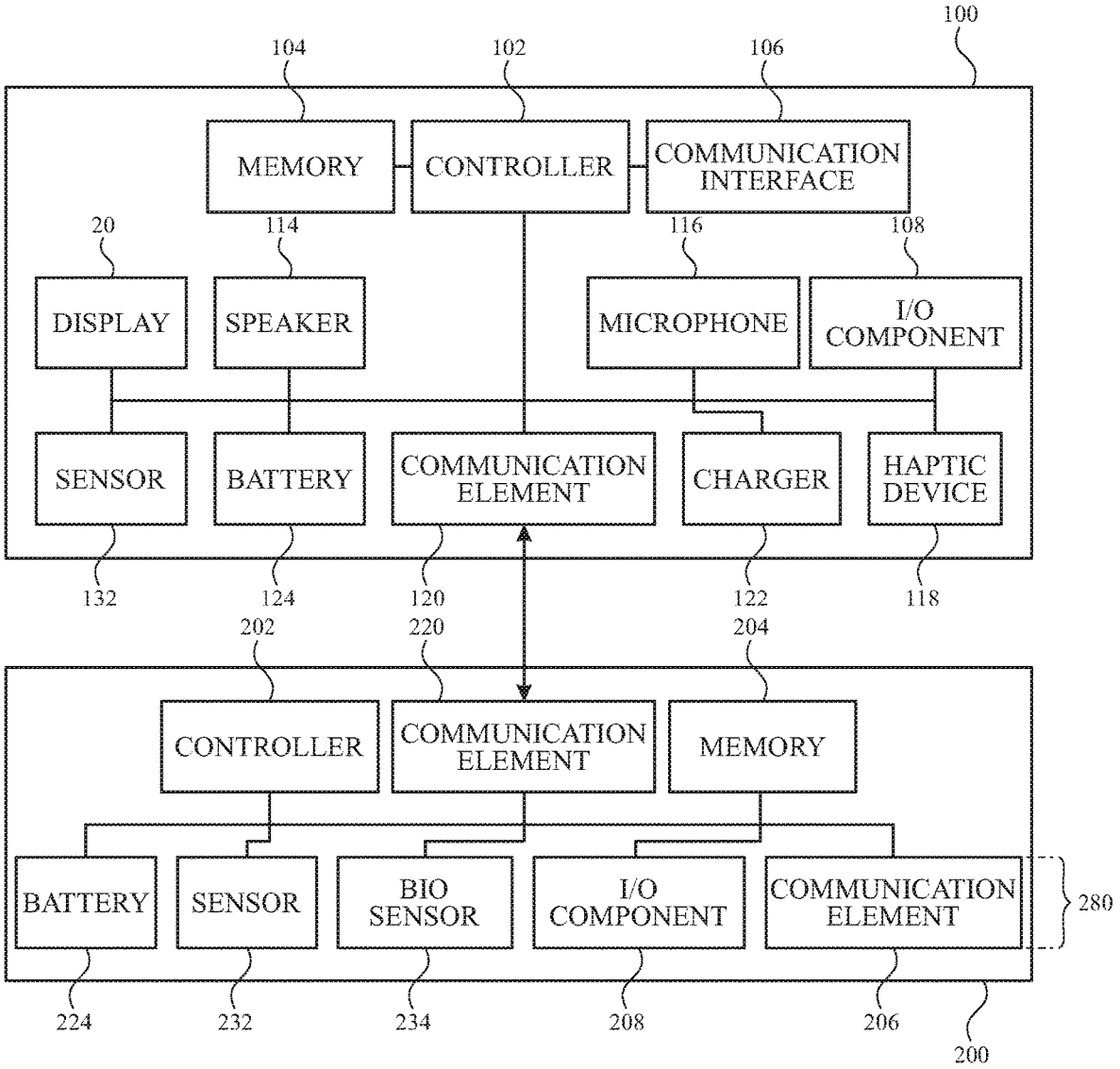
FIG. 14 illustrates a block diagram of a watch body and a functional module, in accordance with some embodiments of the present disclosure.

FIG. 14 illustrates a block diagram of a watch body and a functional module, in accordance with some embodiments of the present disclosure.

As shown in FIG. 14, the body 100 includes a controller 102 with one or more processing units that include or are configured to access a memory 104 having instructions stored thereon. The instructions or computer programs may be configured to perform one or more of the operations or functions described with respect to the body 100. The controller 102 can be implemented as any electronic device capable of processing, receiving, or transmitting data or instructions. For example, the controller 102 may include one or more of: a microprocessor, a central processing unit (CPU), an application-specific integrated circuit (ASIC), a digital signal processor (DSP), or combinations of such devices. As described herein, the term "processor" is meant to encompass a single processor or processing unit, multiple processors, multiple processing units, or other suitably configured computing element or elements. The memory 104 can store electronic data that can be used by the body 100. For example, the memory 104 can store electrical data or content such as, for example, audio and video files, documents and applications, device settings and user preferences, timing and control signals or data for the various modules, data structures or databases, and so on. The memory 104 can be configured as any type of memory. By way of example only, the memory 104 can be implemented as random access memory, read-only memory, Flash memory, removable memory, or other types of storage elements, or combinations of such devices.

As further illustrated in FIG. 14, the body 100 can include components for interacting with a user. For example, the body 100 can include the display 20. The display 20 can provide visual (e.g., image or video) output. The display 20 may also provide an input surface for a sensor 132, such as a touch sensing device, a force sensing device, a temperature sensing device, a capacitive sensing device, a resistive sensing device, and/or a fingerprint sensor. The display 20 may be any size suitable for inclusion at least partially on or within the housing of the body 100 and may be positioned substantially anywhere on the body 100.

The body 100 can further include one or more other user interfaces for receiving input from and/or providing output to a user. Examples of such interfaces include a speaker 114, a microphone 116, a haptic device 118, and/or another I/O component 108. The haptic device 118 can be implemented as any suitable device configured to provide force feedback, vibratory feedback, tactile sensations, and the like. For example, in one embodiment, the haptic device 118 may be implemented as a linear actuator configured to provide a punctuated haptic feedback, such as a tap or a knock. Examples of other user interfaces include one or more buttons, dials, crowns, switches, or other devices can be provided for receiving input from a user.

As further shown in FIG. 14, the body 100 may include a communication component 106 that facilitates transmission of data and/or power to or from other electronic devices across standardized or proprietary protocols. For example, a communication component 106 can transmit electronic signals via a wireless and/or wired network connection. Examples of wireless and wired network connections include, but are not limited to, cellular, Wi-Fi, Bluetooth, infrared, RFID, and Ethernet.

As further shown in FIG. 14, the body 100 can include a battery 124 that is used to store and provide power to the other components of the body 100. The battery 124 may be a rechargeable power supply that is configured to provide power to the body 100. The body 100 can also include a charger 122 to recharge the battery 124, for example, using a wireless (e.g., inductive) charging system. The battery 124 can be a replaceable battery, a rechargeable battery or, a tethered power source that receives power from a source external to the body 100, such as from a USB cable, Lightning cable, or other interface.

As further shown in FIG. 14, the functional module 200 includes components to perform selected functions and to interact with the body 100.

As shown in FIG. 14, the body 100 can include the body communication interface 120, and the functional module 200 can include the module communication interface 220 to facilitate a communication link between the body 100 and the functional module 200. For example, the communication link can operably connect components of the body 100, such as the controller 102) to components 280 of the functional module 200.

As further shown in FIG. 14, the functional module 200 can include a controller 202 with one or more processing units that include or are configured to access a memory 204 having instructions stored thereon. The controller 202 and/or the memory 204 of the functional module 200 can be the same as, similar to, or different than the controller 102 and/or the memory 104 of the body 100.

Additionally or alternatively, the functional module 200 can be controlled at least in part by the controller 102 of the body 100. For example, while the functional module 200 is connected to the body 100, the controller 102 of the body 100 can operably connect to and/or control one or more components of the functional module 200 via the communication link provided by the body communication interface 120 and the module communication interface 220.

Additionally or alternatively, the body 100 can be controlled at least in part by the controller 202 of the functional module 200. For example, while the functional module 200 is connected to the body 100, the controller 202 of the functional module 200 can operably connect to and/or control one or more components of the body 100 via the communication link provided by the body communication interface 120 and the module communication interface 220.

The functional module 200 can operate as an auxiliary power source for the body 100. By providing auxiliary power with a removable module, the user can select such a functional module when the battery 124 is low or when additional power is required or expected. As shown in FIG. 14, the functional module 200 can include a battery 224 that is used to store and provide power to the body 100 and/or the functional module 200. The functional module 200 can recharge the battery 124 of the body 100, for example, by directing power from the battery 224 across the body communication interface 120 and the module communication interface 220. Other pathways are contemplated, such as another link or wireless charging. The battery 224 can be a replaceable battery, a rechargeable battery, or a tethered power source that receives power from a source external to the functional module 200, such as from a USB cable, Lightening cable, or other interface.

The functional module 200 can provide sensing capabilities with one or more sensors. By providing sensing capabilities with a removable module, the user can select such a functional module when sensing particular conditions is desired. As shown in FIG. 14, the functional module 200 can include one or more sensors 232. The one or more sensors 232 can be configured to sense substantially any type of characteristic such as, but not limited to, images, pressure, light, touch, force, temperature, position, motion, and so on. For example, the sensor(s) 232 may be a photodetector, a temperature sensor, a light or optical sensor, an atmospheric pressure sensor, a humidity sensor, a magnet, a gyroscope, an accelerometer, a chemical sensor, an ozone sensor, a particulate count sensor, and so on. The sensor 232 can be used to sense ambient conditions in a neighboring environment. The sensor 232 can be provided with exposure to the environment, for example with an opening in the functional module 200.

The functional module 200 can provide bio-sensing capabilities with one or more sensors. By providing bio-sensing capabilities with a removable module, the user can select such a functional module when tracking biometric characteristics, such as health and activity metrics, is desired. As shown in FIG. 14, the functional module 200 can include one or more bio-sensors 234. The one or more bio-sensors 234 can include optical and/or electronic biometric sensors that may be used to compute one or more biometric characteristics. For example, a bio-sensor 234 can include a light source and a photodetector to form a photoplethysmography (PPG) sensor. Light can be transmitted from the bio-sensor 234, to the user, and back to the bio-sensor 234. The functional module 200 can provide one or more windows (e.g., opening, transmission medium, and/or lens) to transmit light to and/or from the bio-sensor 234. An optical (e.g., PPG) sensor or sensors may be used to compute various biometric characteristic including, without limitation, a heart rate, a respiration rate, blood oxygenation level, a blood volume estimate, blood pressure, or a combination thereof. One or more of the bio-sensors 234 may also be configured to perform an electrical measurement using one or more electrodes. The electrical sensor(s) may be used to measure electrocardiographic (ECG) characteristics, galvanic skin resistance, and other electrical properties of the user's body. Additionally or alternatively, a bio-sensor 234 can be configured to measure body temperature, exposure to UV radiation, and other health-related information.

The functional module 200 can include a component for receiving input from a user, providing output to a user, and/or performing other functions. As shown in FIG. 14, the functional module 200 can include one or more I/O components 208. Examples of such components include a speaker, a microphone, a display, a touch sensor, a haptic device, a camera, an optical sensor, a magnet, a gyroscope, an accelerometer, and/or another I/O component. The I/O components 208 can be used to detect and interpret user inputs. The I/O components 208 can be used to provide information to the user. The I/O components 208 can also be used to capture information relating to the user and/or the environment.

The functional module 200 can provide a capability to communicate with other devices. The user can select such a functional module when these communication links are desired. As shown in FIG. 14, a communication interface 206 facilitates transmission of data and/or power to or from other electronic devices. As previously discussed, the communication interface 206 can be used control, communicate with, and/or receive data from a watch band. In such a configuration, the communication interface 206 can be positioned at a band retaining feature 16 of the functional module. In other configurations, the communication interface 206 can be used to control and/or communicate with other devices. For example, the communication interface 206 can be used to connect to another device that performs diagnostic and/or repair functions. Accordingly, the communication interface 206 can be used to provide a communication link to the functional module 200 and/or the body 100 of the watch. The communication link provided by the communication interface 206 can include standardized or proprietary protocols, such as with electronic signals via a wireless and/or wired network connection. Examples of wireless and wired network connections include, but are not limited to, Wi-Fi, Bluetooth, infrared, RFID, and Ethernet.

Accordingly, embodiments of the present disclosure provide a watch with exchangeable modules that provide a variety of different components and functions to achieve the results that are desired by a user. The modular configurations allow a user to easily customize a watch with one or more functional modules to provide features that integrate with other operations of the body of the watch. The functional modules can be easily exchanged with each other to provide different components and functions at different times. Accordingly, a watch body of the present disclosure need not include permanent components that provide every function that will later be desired by the user. Instead, the watch can have expanded and customizable capabilities by the use of one or more functional modules.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language of the claims and to encompass all legal equivalents. Notwithstanding, none of the claims are intended to embrace subject matter that fails to satisfy the requirements of the applicable patent law, nor should they be interpreted in such a way.

What is claimed is:

1. A watch comprising:

a body comprising:

a housing having a first side and a second side opposite the first side;

a controller;

a display supported on the first side of the housing;

band retaining features on opposing sides of the housing for releasably connecting the body to a watch band;

a first attachment element; and a first communication interface provided on the second side of the housing;

a functional module comprising:

an electronic component;

a second attachment element; and a second communication interface arranged such that, when the functional module is attached to the body at the second side of the housing, the controller is operably connected to the electronic component via the first communication interface and the second communication interface; and a release mechanism on an outer surface of the watch for releasing the functional module from the body.

2. The watch of claim 1, wherein the body further comprises:

a microphone;

a speaker;

a button for receiving input from user; and a communication component for communicating wirelessly with another device.

3. The watch of claim 1, wherein the first communication interface is supported on the first attachment element, and the second communication interface is supported on the second attachment element.

4. The watch of claim 1, wherein the electronic component is a sensor configured to detect a characteristic of a user.

5. The watch of claim 1, wherein the first attachment element and the second attachment element guide movement of the functional module relative to the housing until the first communication interface is electrically connected to the second communication interface.

6. The watch of claim 1, wherein the first attachment element and the second attachment element enclose a space with a water-tight seal.

7. The watch of claim 1, wherein the first communication interface or the second communication interface comprises a pogo pin.

8. The watch of claim 1, wherein the electronic component comprises a communication component for communicating with another device.

9. A watch comprising:

a body comprising:

a housing having a first side and a second side opposite the first side;

a controller within the housing;

a display supported on the first side of the housing;

band retaining features on opposing sides of the housing for releasably connecting the body to a watch band;

a first communication interface provided on the second side of the housing; and a touch sensor configured to receive a touch input at the display; and a functional module removably attachable to the second side of the housing and comprising an electronic component operably connected to the controller when the functional module is attached to the second side of the housing, the functional module being exchangeable with other functional modules that are removably attachable to the housing, wherein the functional module further comprises a second communication interface arranged such that, when the functional module is attached to the body at the second side of the housing, the controller is operably connected to the electronic component via the first communication interface and the second communication interface.

10. The watch of claim 9, wherein:

the body further comprises:

a first attachment element; and the functional module further comprises:

a second attachment element; and wherein, when the functional module is attached to the body, the first attachment element and the second attachment element form a seal to enclose a space and the controller is operably connected to the electronic component via the first communication interface and the second communication interface within the space; and a release mechanism on an outer surface of the watch for releasing the functional module from the housing.

11. The watch of claim 9, wherein the functional module is removable from the housing without requiring deformation of the functional module or the housing.

12. The watch of claim 9, wherein the functional module is exchangeable with other functional modules on the housing without requiring a tool.

13. The watch of claim 9, wherein the body further comprises band retaining features on opposing sides of the housing for releasably connecting the body to a watch band.

14. The watch of claim 9, wherein the electronic component is a sensor configured to detect a characteristic of a user.

15. The watch of claim 9, wherein the electronic component is a sensor configured to detect a characteristic of an environment external to the watch.

16. A system comprising:

a watch body comprising:

a housing having a first side and a second side opposite the first side;

a controller within the housing;

an attachment element arranged on the second side of the housing;

a display supported on the first side of the housing;

a first communication interface provided on the second side of the housing; and band retaining features on opposing sides of the housing;

a watch band releasably connectable to the housing by the band retaining features;

a first functional module comprising a first electronic component for performing a first function, wherein the first electronic component is operably connected to the controller when the first functional module is attached to the attachment element; and a second functional module comprising a second electronic component for performing a second function, different than the first function, wherein the second electronic component is operably connected to the controller when the second functional module is attached to the attachment element, wherein at least one of the first and second function modules further comprises a second communication interface arranged such that, when at least one of said first or second functional modules is attached to the body at the second side of the housing, the controller is operably connected to the electronic component via the first communication interface and the second communication interface.

17. The system of claim 16, wherein:

the first functional module comprises a first sensor configured to detect a first characteristic of a user; and the second functional module comprises a second sensor configured to detect a second characteristic of the user, different than the first characteristic.

18. The system of claim 16, wherein the watch body further comprises a release mechanism on an outer surface of the watch body for releasing the first functional module or the second functional module from the attachment element.

* * * * *